US009079393B2

(12) United States Patent
Hiyoshi et al.

(10) Patent No.: US 9,079,393 B2
(45) Date of Patent: Jul. 14, 2015

(54) INK JET HEAD

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Teruyuki Hiyoshi, Izunokuni (JP); Noboru Nitta, Shizuoka-ken (JP); Shunichi Ono, Izu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/445,348

(22) Filed: Jul. 29, 2014

(65) Prior Publication Data

US 2015/0116403 A1 Apr. 30, 2015

(30) Foreign Application Priority Data

Oct. 30, 2013 (JP) ..... 2013-225981

(51) Int. Cl.
*B41J 29/38* (2006.01)
*B41J 2/045* (2006.01)

(52) U.S. Cl.
CPC ..... *B41J 2/04591* (2013.01); *B41J 2/04581* (2013.01); *B41J 2/04588* (2013.01); *B41J 2/04596* (2013.01); *B41J 2/04598* (2013.01); *B41J 2/04541* (2013.01); *B41J 2/04593* (2013.01)

(58) Field of Classification Search
CPC ..... B41J 2/04588; B41J 2/04581; B41J 2/04596; B41J 2/04541; B41J 2/04593
USPC ..... 347/11, 10, 12, 14, 69
See application file for complete search history.

(56) References Cited

U.S. PATENT DOCUMENTS

| | | | | |
|---|---|---|---|---|
| 5,400,064 | A * | 3/1995 | Pies et al. | 347/68 |
| 6,416,149 | B2 * | 7/2002 | Takahashi | 347/10 |
| 7,669,987 | B2 | 3/2010 | Kusunoki et al. | |
| 8,348,374 | B2 * | 1/2013 | Kusunoki | 347/14 |

* cited by examiner

*Primary Examiner* — Manish S Shah
*Assistant Examiner* — Yaovi Ameh
(74) *Attorney, Agent, or Firm* — Amin, Turocy & Watson, LLP

(57) ABSTRACT

In accordance with one embodiment, an ink jet head comprises a driving signal generator configured to apply rectangular waveform electric field pulse to a partition wall forming a pressure chamber for ejecting ink; wherein the driving signal generator applies, to a second partition wall adjacent to a first partition wall forming the pressure chamber for ejecting ink and a third partition wall adjacent to the second partition wall, electric field pulse including at least one rectangular waveform which is a rectangular waveform opposite to the electric field pulse applied to the adjacent first partition wall and has a pulse width determined based on the electric field pulse at the timing corresponding to the electric field pulse applied to the first partition wall, in a case of ejecting ink from any of the plurality of pressure chambers.

9 Claims, 7 Drawing Sheets

A-A SECTION

B-B SECTION (a)VOLTAGE OF ELECTRODE (b)ELECTRIC FIELD OF ACTUATOR

INK JET HEAD

CROSS-REFERENCE TO RELATED APPLICATION

This application is based upon and claims the benefit of priority from Japanese Patent Application No. 2013-225981, filed Oct. 30, 2013, the entire contents of which are incorporated herein by reference.

FIELD

Embodiments described herein relate to an ink jet head.

BACKGROUND

Conventionally, there is known a so-called inkjet head of "shared wall head" type which takes partition wall of adjacent pressure chambers as an actuator. In such a type of ink jet head, there is a problem that the pressure vibration occurring in the pressure chamber deforms the actuator, and transmits to the adjacent pressure chamber, as a result, "crosstalk" occurs, and the speed and volume of the ejected ink drops vary according to image pattern.

To solve such a problem, a technology is disclosed in which the actuator is driven through dummy pulse to intentionally generate pressure vibration in the pressure chamber not to eject ink, and the variation of the ejecting speed and volume of the ink drops is corrected through the crosstalk of the pressure vibration.

DETAILED DESCRIPTION

In accordance with one embodiment, an ink jet head comprises a plurality of partition walls configured to partition a plurality of pressure chambers each of which is respectively communicated with each of a plurality of ink ejection nozzles, and be capable of changing the volume of each pressure chamber according to supplied driving signals; a plurality of electrodes configured corresponding to each of the plurality of pressure chambers, respectively; and a driving signal generator configured to supply driving signals for ink ejecting to the electrode corresponding to the pressure chamber for ejecting ink and the electrode corresponding to a pressure chamber adjacent to the pressure chamber for ejecting ink to apply rectangular waveform electric field pulse to the partition wall forming the pressure chamber for ejecting ink; wherein the driving signal generator applies, to a second partition wall adjacent to a first partition wall forming the pressure chamber for ejecting ink and a third partition wall adjacent to the second partition wall, electric field pulse including at least one rectangular waveform which is a rectangular waveform opposite to the electric field pulse applied to the adjacent first partition wall and has a pulse width determined based on the electric field pulse at the timing corresponding to the electric field pulse applied to the first partition wall, in a case of ejecting ink from any of the plurality of pressure chambers.

The embodiments are described below with reference to the accompanying drawings.

A First Embodiment

First, the first embodiment is described below.

Figure 1:
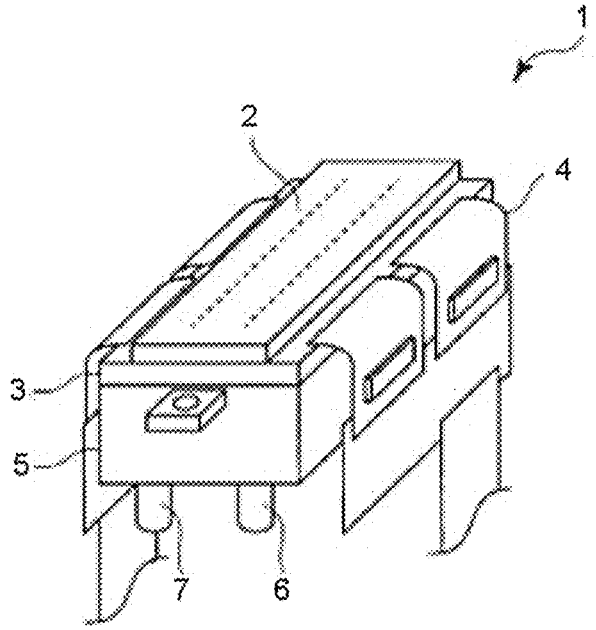
FIG. 1 is an external view of an ink jet head according to a first embodiment.

FIG. 1 is a perspective view of an ink jet head 1 of an inkjet recording apparatus according to the first embodiment.

The ink jet head 1 comprises a head substrate 3 provided with a nozzle 2 for ejecting ink, a driver IC 4 for generating a driving signal and a manifold 5 provided with an ink feed port 6 and an ink discharge port 7.

The ink jet head 1 ejects the ink fed from the ink feed port 6 from the nozzle 2 in response to the driving signal generated by the driver IC 4. In the ink fed through the ink feed port 6, the ink which is not ejected from the nozzle 2 is discharged from the ink discharge port 7.

Figure 2:
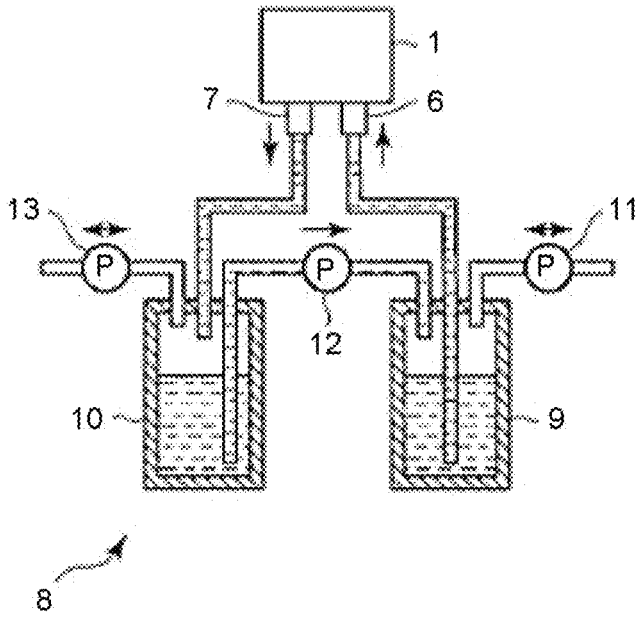
FIG. 2 is a diagram illustrating the constitution of an ink feed device according—to the first embodiment.

FIG. 2 is a schematic diagram illustrating an ink feed device 8 used in the inkjet recording apparatus according to the first embodiment. The ink feed device 8 consists of a feed-side ink tank 9, a discharge-side ink tank 10, a feed-side pressure adjustment pump 11, a transport pump 12, a discharge-side pressure adjustment pump 13 and tubes for fluidly connecting these components.

The feed-side pressure adjustment pump 11 and the discharge-side pressure adjustment pump 13 adjust the pressure of the feed-side ink tank 9 and the pressure of the discharge-side ink tank 10, respectively. The feed-side ink tank 9 feeds ink to the ink feed port 6 of the ink jet head 1. The discharge-side ink tank 10 temporarily stores the ink discharged from the ink discharge port 7 of the ink jet head 1. The transport pump 12 makes the ink stored in the discharge-side ink tank 10 to be returned back to the feed-side ink tank 9.

Next, the detailed constitution of the ink jet head 1 is described.

Figure 3:
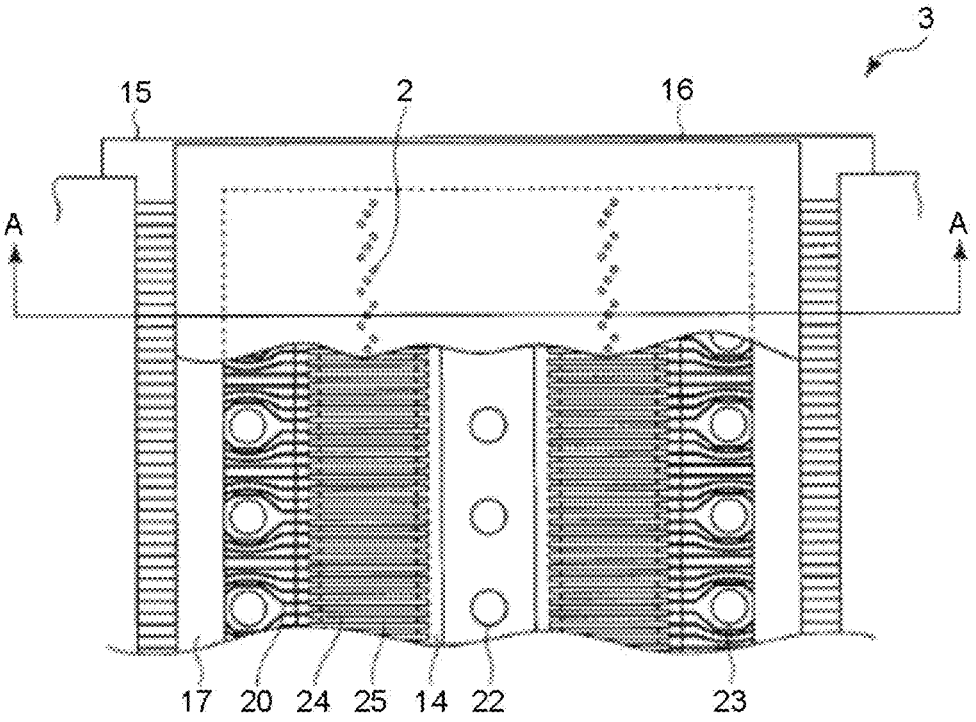
FIG. 3 is a plan view of the ink jet head according to the first embodiment.
Figure 4:
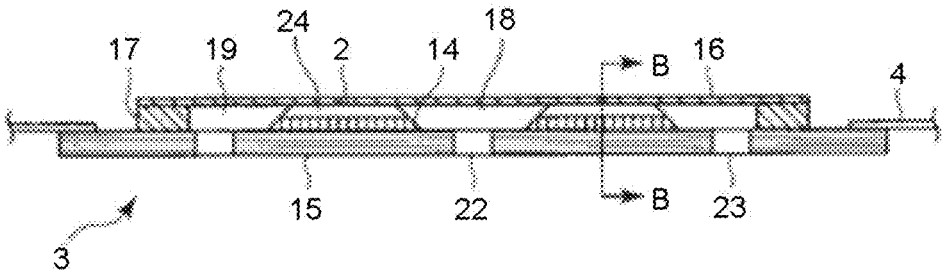
FIG. 4 is a longitudinal section view of the ink jet head according to the first embodiment.
Figure 5:
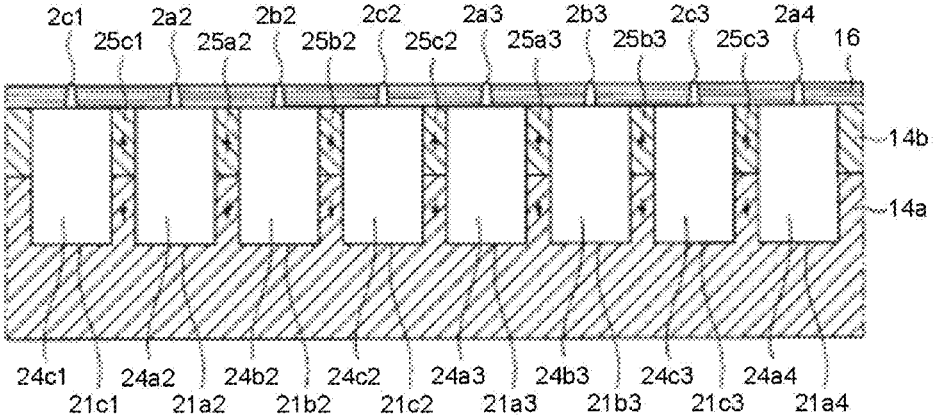
FIG. 5 is a cross-section view of the ink jet head according to the first embodiment.

FIG. 3 is a plan view of the head substrate 3. FIG. 4 is an A-A longitudinal section view of the head substrate 3. FIG. 5 is a B-B cross-section view of the head substrate 3. The head substrate 3 consists of a piezoelectric member 14, a base substrate 15, a nozzle plate 16 and a frame member 17. The space surrounded by the base substrate 15, the piezoelectric member 14 and the nozzle plate 16 forms an ink feed path 18. The space surrounded by the base substrate 15, the piezoelectric member 14, the frame member 17 and the nozzle plate 16 forms an ink discharge path 19.

A wiring electrode 20 (refer to FIG. 3) is formed in the base substrate 15 to electrically connect an electrode 21 formed on the inner surface of a pressure chamber 24 with the driver IC 4. Further, ink feed holes 22 communicating with the ink feed path 18 and ink discharge holes 23 communicating with the ink discharge path 19 are formed in the base substrate 15. The ink feed holes 22 are fluidly connected with the ink feed port 6 through the manifold 5. The ink discharge holes 23 are fluidly connected with the ink discharge port 7 through the manifold 5. The base substrate 15 is preferred to be made from material having small dielectric constant and small difference of thermal expansion coefficient with the piezoelectric member. The material of the base substrate 15 may be, for example, alumina (Al2O3), siliconnitride (Si3N4), silicon carbide (Sic), aluminum nitride (AlN), lead zirconate titanate (PZT) and the like. In the present embodiment, the PZT with small dielectric constant is used.

The piezoelectric member 14 is cemented on the base substrate 15. The piezoelectric member 14 (refer to FIG. 5) is formed by laminating a piezoelectric member 14*a* and a piezoelectric member 14*b* which are polarized in two opposite directions along the plate thickness direction. A plurality of long grooves starting from the ink feed path 18 and leading to the ink discharge path 19 are formed in parallel in the piezoelectric member 14, and the electrode 21 is formed in the inner surface of each long groove. The space surrounded by the long groove and one surface of the nozzle plate 16 arranged on the piezoelectric member 14 to cover the long groove forms the pressure chamber 24. The electrode 21 is connected with the driver IC 4 through the wiring electrode 20. The piezoelectric member 14 constituting the partition wall between the adjacent pressure chambers 24 is nipped by the electrode 21 arranged in each pressure chamber 24 and forms an actuator 25. If electric field is applied to the actuator 25 according to the driving signal generated by the driver IC 4, the actuator 25 deforms into a "<" shape with the cementing part of the piezoelectric member 14*a* and the piezoelectric member 14*b* as the top. Through the deformation of the actuator 25, the volume of the pressure chamber 24 changes and the ink inside the pressure chamber 24 is pressurized. The pressurized ink is ejected from the nozzle 2. The piezoelectric member 14 is lead zirconate titanate (PZT: Pb (Zr, Ti) O3), lithium niobate (LiNbO3), lithium tantalate (LiTaO3) and the like. In the present embodiment, the lead zirconate titanate (PZT) with high piezoelectric constant is used.

The electrode 21 includes two layers: nickel (Ni) and gold (Au). The electrode 21 is deposited uniformly inside the long groove through, for example, a plating method. Further, as the forming method of the electrode 21, a sputtering method and an evaporation method may also be used in addition to the plating method. The pressure chambers 24 having a depth of 300 μm and a width of 80 μm are arranged in parallel at a pitch of 169 μm.

The nozzle plate 16 is bonded on the piezoelectric member 14. The nozzles 2 are formed in the nozzle plate 16 at positions which are offset every three cycles from the center part of the pressure chamber 24 in the longitudinal direction. As to the material of the nozzle plate 16, the metal material such as stainless, the inorganic material such as single crystal silicon and resin material such as polyimide film can be used. In addition, in the present embodiment, an example is described in which the polyimide film is adopted. After the nozzle plate 16 is bonded on the piezoelectric member 14, hole drilling processing is carried out by an excimer laser and the like to form nozzles with high precision. The nozzle 2 is formed into a tapered shape from the pressure chamber 24 to the ink ejecting side. In a case where the material is stainless, the nozzle 2 can be formed through pressing processing. Further, in a case where the material is single-crystal silicon, the nozzle 2 can be formed through dry etching or wet etching and the like based on photolithography.

As stated above, the shear mode/shared wall type ink jet head which is suitable for the application of the present embodiment is described. In the description above, it is exemplified that the ink feed path 18 is arranged at one end of the pressure chamber 24, the ink discharge path 19 is arranged at the other end of the pressure chamber 24, and the nozzles 2 are arranged at the center part of the pressure chamber 24; however, the application range of the present embodiment is not limited to this. It goes without saying that the nozzles may be arranged at one end of the pressure chamber 24 and the ink feed path may be arranged at the other end.

Figure 6:
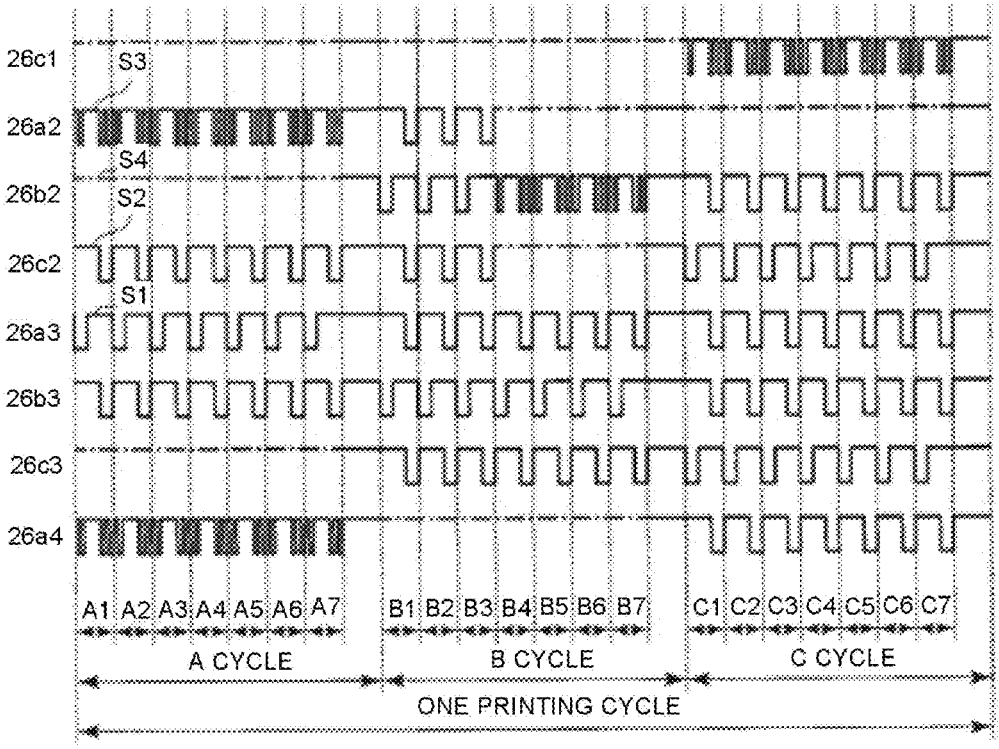
FIG. 6 is a diagram illustrating driving signals according to the first embodiment.

FIG. 6 is a diagram illustrating one example of the driving signals supplied by the driver IC 4 for channels 26*c*1~26*a*4. Herein, the "channel" refers to the set of the electrode 21, the pressure chamber 24 and the nozzle 2. One printing cycle of the driving signal is divided into an "A cycle", a "B cycle" and a "C cycle", and the channel corresponding to each cycle is subjected to a time-division driving. The cycle of each channel is assigned in such a manner that the cycles of adjacent channels are different from each other.

At most seven drops of ink drop are ejected in one cycle. The number of ink drops ejected in one pixel can be changed, thus, the printing can be carried out in eight gradations from number of drops 0~number of drops 7. The marks A1~A7 respectively refer to the timing for ejecting the first-seventh drop of ink in the A cycle. The marks B1~B7 and the marks C1~C7 are the same as the marks A1~A7. However, the present invention is not limited to the gradation printing, and it may also be applied to a case of ejecting only one drop of ink for the pixel carrying out printing or in a case of always ejecting a plurality of drops of ink for the pixel carrying out printing.

The driving signal includes four categories of S1~S4. The driving signal S1 is supplied to the channel ejecting ink. The driving signal S2 is supplied to the channel adjacent to the channel ejecting ink. The driving signal S3 is supplied to the channel not ejecting ink. The driving signal S4 is supplied to the channel adjacent to the channel not ejecting ink.

Figure 7:
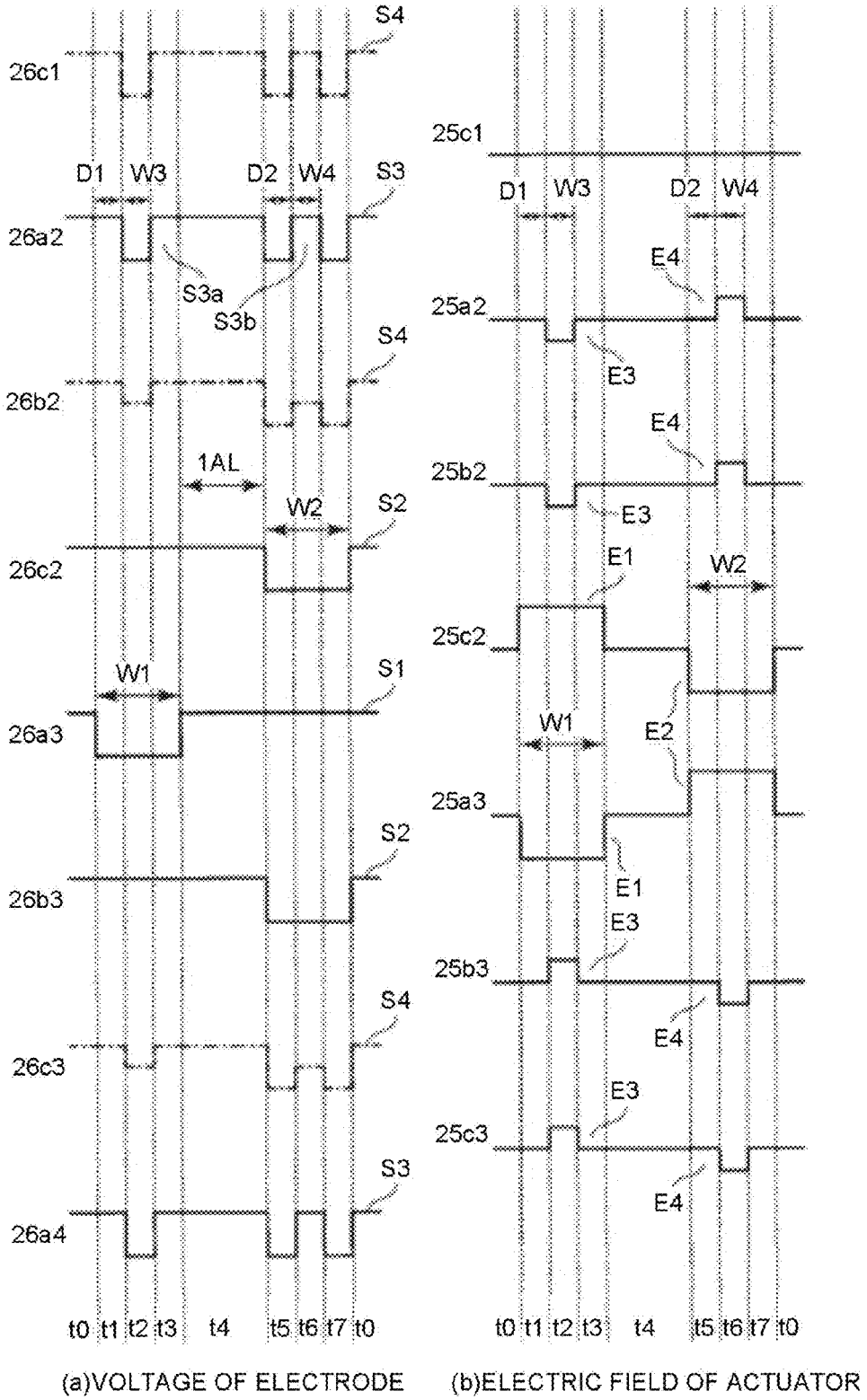
FIG. 7 is a detail view of the driving signals according to the first embodiment.

FIG. 7 (*a*) is a diagram illustrating the detail of the driving signals S1-S4.

The driving signal S1, which is a rectangular waveform pulse having a pulse width W1, drives the channel to eject ink from the nozzle 2. The pulse width W1 is preferred to be 1AL. Herein, "AL" is ½ of an acoustic resonance period of the ink in the pressure chamber 24. The driving signal S2, which is a rectangular waveform pulse having a pulse width W2, reduces the residual pressure vibration in the pressure chamber 24. In the present embodiment, though the pulse width W2 is 1AL, the pulse width can be adjusted according to the attenuation rate of the residual pressure vibration.

The temporal center of the driving signal S2 has a delay time 2AL later than the temporal center of the driving signal S1

The driving signal S3*a*, a rectangular waveform pulse which has a pulse width W3 and has a delay time D1 later than the driving signal S1, corrects the crosstalk of the pressure vibration generated by the driving signal S1. The driving signal S3*b* including two rectangular waveforms corrects the crosstalk of the pressure vibration generated by the driving signal S2. The first rectangular waveform, of which the falling timing is the same as that of the driving signal S2, has a pulse width D2. The falling timing of the second rectangular waveform is D2+W4 and the rising timing is the same as that of the driving signal S2. The time of W3 and W4 is adjusted according to the crosstalk characteristic of the ink jet head.

The driving signal S4 is subjected to high impedance control and does not carry out driving. The voltage level of the driving signal S4, when nipped between the driving signal S2 and the driving signal S3, displaces according to the driving signal S2 and the driving signal S3. Further, in a case of not being nipped between the driving signal S2 and the driving signal S3, that is, in a case of being nipped between the driving signal S3 and the driving signal S4, the level displaces according to the driving signal S3 and the driving signal S4. Generally, the level is based on the driving signal S3.

The voltage amplitude of the driving signals S1~S3 is the same, and the generation of the driving signals S1~S3 can be carried out by the minimum switching element. The driving signal S4 carries out a control by turning off all the switching elements.

FIG. 7 (*b*) is a diagram illustrating the electric fields generated in the actuator 25 through the driving signals S1~S4.

The polarity of the electric field indicates the direction in which the actuator deforms. If the driving signal S1 is supplied to the channel 26*a*3, the electric field pulse E1 acts on the actuator 25*c*2 and the actuator 25*a*3 constituting the side wall of the pressure chamber 24*a*3, and the volume of the pressure chamber 24*a*3 is expanded and then returns to original state after 1AL. Through such a volume change, pressure vibration is generated in the ink inside the pressure chamber 24*a*3, and therefore, the ink is ejected from the nozzle 2*a*3.

Simultaneously, the volumes of the pressure chamber 24*c*2 and the pressure chamber 24*b*3 change, pressure vibration is generated in the ink inside the pressure chamber 24*c*2 and the pressure chamber 24*b*3, and the pressure vibration deforms the actuator 25*b*2 and the actuator 25*b*3, and pressure vibration is generated in the pressure chamber 24*b*2 and the pressure chamber 24*c*3. The pressure vibration of the pressure chamber 24*b*2 and the pressure chamber 24*c*3 becomes crosstalk. In addition, the volumes of the pressure chamber 24*b*2 and the pressure chamber 24*c*3 change, pressure vibration is generated in the ink inside the pressure chamber 24*b*2 and the pressure chamber 24*c*3, and the pressure vibration deforms the actuator 25*a*2 and the actuator 25*c*3, and pressure vibration is generated in the pressure chamber 24*a*2 and the pressure chamber 24*a*4.

However, in accordance with the constitution of the present embodiment, the electric field pulse E3 acts on the actuator 25*a*2, the actuator 25*b*2, the actuator 25*b*3 and the actuator 25*c*3 under the action of the driving signal S2 and the driving signal S3, and along with the ink ejecting operation of the channel 26*a*3, the deformation of the actuator 25*b*2, the actuator 25*b*3, the actuator 25*a*2 and the actuator 25*c*3 caused by the pressure vibration of the pressure chamber 24*c*2, the pressure chamber 24*b*3, the pressure chamber 24*b*2 and the pressure chamber 24*c*3 is offset. In addition, as shown in FIG. 7, the polarity of the electric field pulse E3 is opposite to the polarity of the electric field pulse E1, and for example, the height of the electric field pulse E4 (obtained by inverting the polarity of the electric field pulse E3) is about half of the height of the electric field pulse E2. That is, the voltage level is about half. Similarly, the polarity of the electric field pulse E3 is opposite to the polarity of the electric field pulse E1, and for example, the height of the electric field pulse E4 (obtained by inverting the polarity of the electric field pulse E4) is about half of the height of the electric field pulse E2. That is, the voltage level is about half.

Figure 8A:
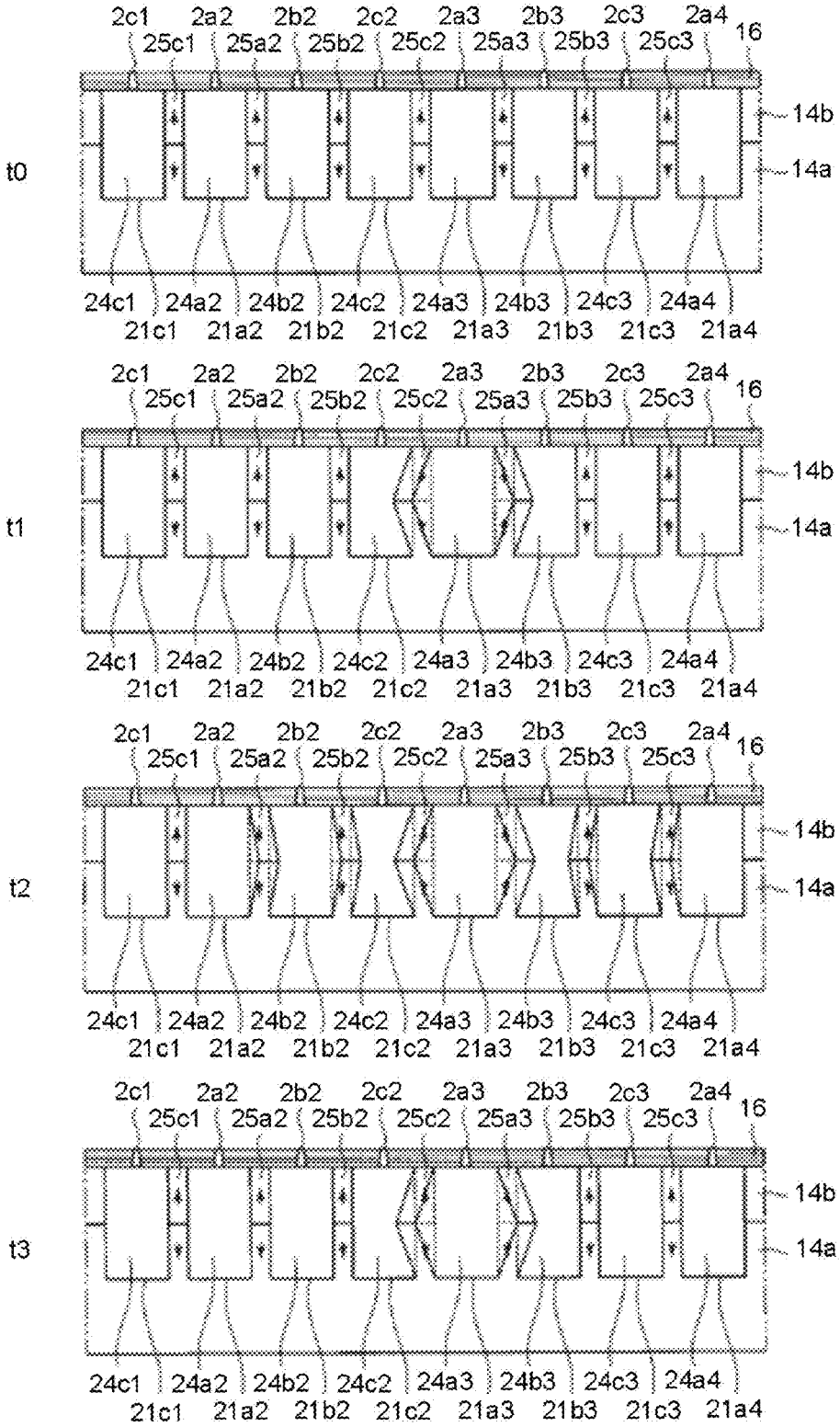
FIG. 8A is a cross-section view illustrating operations according to the first embodiment.
Figure 8B:
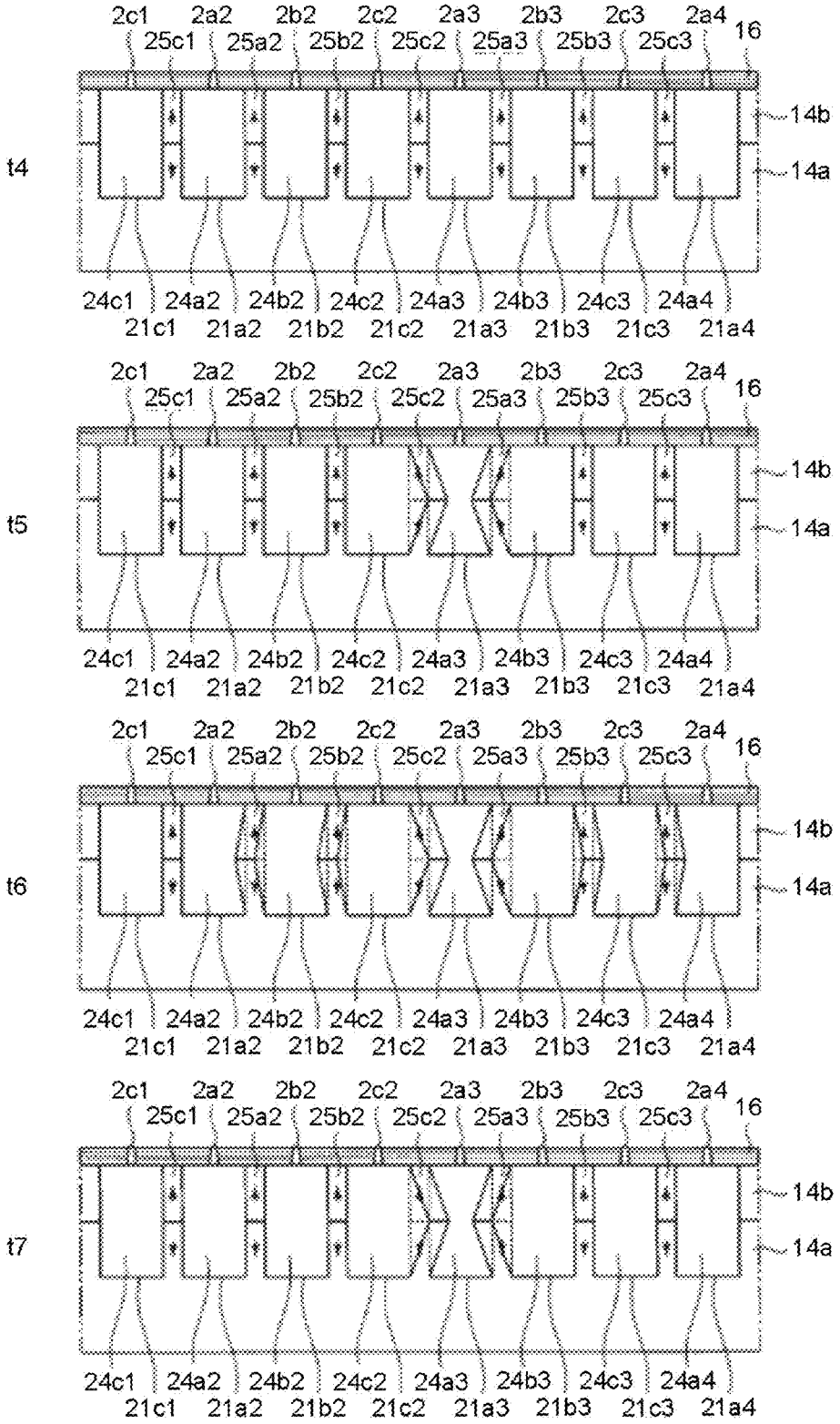
FIG. 8B is a cross-section view illustrating operations according to the first embodiment.

FIG. 8A and FIG. 8B are cross-section views for illustrating a series of operations shown in FIG. 7 in time series.

In the conventional technology for correcting the crosstalk, the voltage amplitude of the driving signal for crosstalk correction is adjusted to set a proper crosstalk correction amount. Thus, the conventional ink jet head drive circuit has to selectively supply, to each channel, not only the driving voltage for ejecting ink but also the driving voltage for correcting the crosstalk, which makes the drive circuit complicated.

In the technology according to the present embodiment, the energization time W3 and W4 of the driving signal S3 for crosstalk correction is adjusted to set the crosstalk correction amount, and the driving signal S4 is subjected to high impedance control, in this way, the electric field is applied to two actuators at one side.

In this way, in the present embodiment, in a case of ejecting ink from any of a plurality of pressure chambers, the electric field pulse (E3 or E4) including at least one rectangular waveform which is a rectangular waveform opposite to the electric field pulse applied to the adjacent first partition wall and has a pulse width determined based on the electric field pulse is applied to the second partition wall adjacent to the first partition wall forming the pressure chamber for ejecting ink and the third partition wall adjacent to the second partition wall at the timing corresponding to the electric field pulse (E1 or E2) applied to the first partitionwall. As a result, the voltage amplitude of the driving signal S3 for crosstalk correction can be made the same as that of the driving signal S1 or S2 for ink ejection, and an effect of simplifying the constitution of the drive circuit can be expected.

Further, the technological idea of the present embodiment is such a technological idea that cancels the pressure wave generated in the channel adjacent to the driving channel, which is different from the conventional technological idea that generates pressure wave of a degree not ejecting ink in the non-driving channel.

Moreover, in the technology according to the present embodiment, it is possible not only to reduce the crosstalk, but also to control and eliminate the crosstalk or make the crosstalk act negatively.

In addition, in the description above, it is described that the electric field pulse E1 acts on the actuator 25*c*2 and the actuator 25*a*3, and the volume of the pressure chamber 24*a*3 is expanded, in response, the electric field pulse E3 acts on the actuator 25*b*2, the actuator 25*b*3, the actuator 25*a*2 and the actuator 25*c*3, and the deformation of the actuator 25*b*2, the actuator 25*b*3, the actuator 25*a*2 and the actuator 25*c*3 is offset. In this case, the electric field pulse E3 applied to the actuator 25*b*2 and the electric field pulse E3 applied to the actuator 25*b*3 are rectangular waveforms having opposite polarities and the same height (strength), further, the electric field pulse E3 applied to the actuator 25*a*2 and the electric field pulse E3 applied to the actuator 25*c*3 are rectangular waveforms having opposite polarities and the same height. That is, the electric field pulses E3 acting on the actuator 25*b*2, the actuator 25*b*3, the actuator 25*a*2 and the actuator 25*c*3 are rectangular waveforms different in polarity and same in height. In addition, the polarities are different, and the height of the rectangular waveforms of the electric field pulses E3 and E4 is about half of the height of the rectangular waveforms of the electric field pulses E1 and E2.

Furthermore, as a modification, the polarities are different, and the strength of the rectangular waveforms of the electric field pulses E3 and E4 acting on the actuator 25*b*2 and the actuator 25*b*3 may be changed with respect to the strength of the rectangular waveforms of the electric field pulses E1 and E2, and further, the strength of the rectangular waveforms of the electric field pulses E3 and E4 acting on the actuator 25*a*2 and the actuator 25*c*3 may be changed with respect to that of the electric field pulses E3 and E4 acting on the actuator 25*b*2 and the actuator 25*b*3. For example, it may be set that the polarities are different, and 'the strength of the electric field pulses E1 and E2'>'the strength of the electric field pulses E3 and E4 acting on the actuator 25*b*2 and the actuator 25*b*3'>'the strength of the electric field pulses E3 and E4 acting on the actuator 25*c*3 and the actuator 25*a*2'. Alternatively, it may be set that the polarities are different, and 'the strength of the electric field pulses E1 and E2'>'the strength of the electric field pulses E3 and E4 acting on the actuator 25*a*2 and the actuator 25*c*3'>'the strength of the electric field pulses E3 and E4 acting on the actuator 25*b*2 and the actuator 25*b*3'. In this way, the deformation of the actuator can be easily corrected.

A Second Embodiment

Next, the second embodiment is described.

Figure 9:
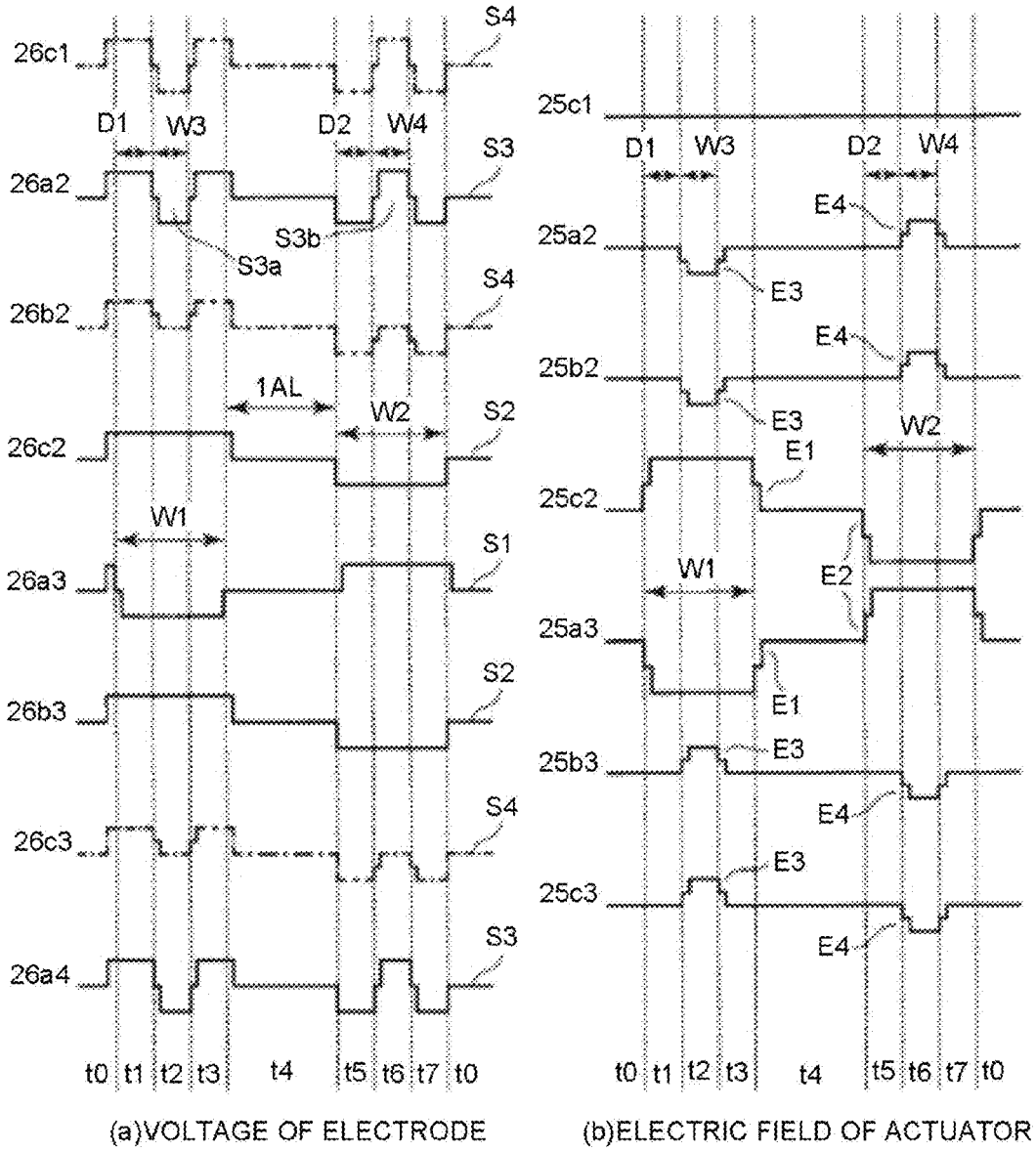
FIG. 9 is a detail view of driving signals according to a second embodiment.

Though a case is described in FIG. 7 (*a*) and FIG. 7 (*b*) in which the control is carried out through the driving signal having a voltage level of two stages, it is also applicable that the control is carried out through the driving signal having a voltage level of three stages, as shown in FIG. 9(*a*) and FIG. 9(*b*).

As stated in detail above, in accordance with the present invention, a technology can be provided in which the crosstalk occurring in a case where the shared wall type ink jet head is adopted can be reduced through a simple driving control.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An ink jet head, comprising:

a plurality of partition walls configured to partition a plurality of pressure chambers each of which is respectively communicated with each of a plurality of ink ejection nozzles, and are capable of changing the volume of each pressure chamber according to supplied driving signals;

a plurality of electrodes configured corresponding to each of the plurality of pressure chambers, respectively; and a driving signal generator configured to supply driving signals for ink ejecting to the electrode corresponding to the pressure chamber for ejecting ink and the electrode corresponding to the pressure chamber adjacent to the pressure chamber for ejecting ink to apply rectangular waveform electric field pulse to the partition wall forming the pressure chamber for ejecting ink; wherein the driving signal generator applies, to a second partition wall adjacent to a first partition wall forming the pressure chamber for ejecting ink and a third partition wall adjacent to the second partition wall, electric field pulse including at least one rectangular waveform which is a rectangular waveform opposite to the electric field pulse applied to the adjacent first partition wall and has a pulse width determined based on the electric field pulse at the timing corresponding to the electric field pulse applied to the first partition wall, in a case of ejecting ink from any of the plurality of pressure chambers.

2. The ink jet head according to claim 1, wherein the driving signal generator applies, in a case of ejecting ink from a first pressure chamber in the plurality of pressure chambers, electric field pulse including at least one rectangular waveform which is a rectangular waveform opposite to the electric field pulse applied to the adjacent first partition wall and has a pulse width determined based on the electric field pulse to the second partition wall adjacent to the first partition wall which is one of the two partition walls forming the first pressure chamber for ejecting ink and the third partition wall adjacent to the second partition wall at the timing corresponding to the electric field pulse applied to the first partition wall; and applies, to a fifth partition wall adjacent to a fourth partition wall which is the other one of the two partition walls forming the first pressure chamber and a sixth partition wall adjacent to the fifth partition wall, electric field pulse including at least one rectangular waveform which is a rectangular waveform opposite to the electric field pulse applied to the adjacent fourth partition wall and has a pulse width determined based on the electric field pulse at the timing corresponding to the electric field pulse applied to the fourth partition wall.

3. The ink jet head according to claim 2, wherein the driving signal generator applies electric field pulse including at least one rectangular waveform which is a rectangular waveform opposite to the electric field pulse applied to the first partition wall and has a pulse width shorter than the pulse width of the electric field pulse to the second partition wall and the third partition wall at the timing corresponding to the electric field pulse applied to the first partition wall, and applies electric field pulse including at least one rectangular waveform which is a rectangular waveform opposite to the electric field pulse applied to the fourth partition wall and has a pulse width shorter than the pulse width of the electric field pulse to the fifth partition wall and the sixth partition wall at the timing corresponding to the electric field pulse applied to the fourth partition wall.

4. The ink jet head according to claim 3, wherein the driving signal generator applies electric field pulse which is a rectangular waveform opposite to the electric field pulse applied to the first partition wall and is half as strong as the electric field pulse to the second partition wall and the third partition wall, and applies electric field pulse which is a rectangular waveform opposite to the electric field pulse applied to the fourth partition wall and is half as strong as the electric field pulse to the fifth partition wall and the sixth partition wall.

5. The ink jet head according to claim 2, wherein the driving signal generator applies electric field pulse which is a rectangular waveform opposite to the electric field pulse applied to the first partition wall and is half as strong as the electric field pulse to the second partition wall and the third partition wall, and applies electric field pulse which is a rectangular waveform opposite to the electric field pulse applied to the fourth partition wall and is half as strong as the electric field pulse to the fifth partition wall and the sixth partition wall.

6. The ink jet head according to claim 5, wherein the driving signal generator applies electric field pulse which is a rectangular waveform opposite to the electric field pulse applied to the first partition wall and has a first strength lower than the strength of the electric field pulse to the second partition wall, and applies electric field pulse which is a rectangular waveform opposite to the electric field pulse applied to the first partition wall and has a second strength lower than the first strength to the third partition wall, and furthermore, applies electric field pulse which is a rectangular waveform opposite to the electric field pulse applied to the fourth partition wall and has the first strength lower than the strength of the electric field pulse to the fifth partition wall, and applies electric field pulse which is a rectangular waveform opposite to the electric field pulse applied to the fourth partition wall and has the second strength lower than the first strength to the sixth partition wall.

7. The ink jet head according to claim 4, wherein the driving signal generator applies electric field pulse which is a rectangular waveform opposite to the electric field pulse applied to the first partition wall and has a first strength lower than the strength of the electric field pulse to the second partition wall, and applies electric field pulse which is a rectangular waveform opposite to the electric field pulse applied to the first partition wall and has a second strength lower than the first strength to the third partition wall, and furthermore, applies electric field pulse which is a rectangular waveform opposite to the electric field pulse applied to the fourth partition wall and has the first strength lower than the strength of the electric field pulse to the fifth partition wall, and applies electric field pulse which is a rectangular waveform opposite to the electric field pulse applied to the fourth partition wall and has the second strength lower than the first strength to the sixth partition wall.

8. The ink jet head according to claim 3, wherein the driving signal generator applies electric field pulse which is a rectangular waveform opposite to the electric field pulse applied to the first partition wall and has a first strength lower than the strength of the electric field pulse to the second partition wall, and applies electric field pulse which is a rectangular waveform opposite to the electric field pulse applied to the first partition wall and has a second strength lower than the first strength to the third partition wall, and furthermore, applies electric field pulse which is a rectangular waveform opposite to the electric field pulse applied to the fourth partition wall and has the first strength lower than the strength of the electric field pulse to the fifth partition wall, and applies electric field pulse which is a rectangular waveform opposite to the electric field pulse applied to the fourth partition wall and has the second strength lower than the first strength to the sixth partition wall.

9. The ink jet head according to claim 2, wherein the driving signal generator applies electric field pulse which is a rectangular waveform opposite to the electric field pulse applied to the first partition wall and has a first strength lower than the strength of the electric field pulse to the second partition wall, and applies electric field pulse which is a rectangular waveform opposite to the electric field pulse applied to the first partition wall and has a second strength lower than the first strength to the third partition wall, and furthermore, applies electric field pulse which is a rectangular waveform opposite to the electric field pulse applied to the fourth partition wall and has the first strength lower than the strength of the electric field pulse to the fifth partition wall, and applies electric field pulse which is a rectangular waveform opposite to the electric field pulse applied to the fourth partition wall and has the second strength lower than the first strength to the sixth partition wall.

* * * * *